US012281827B2

(12) United States Patent
Chang et al.

(10) Patent No.: US 12,281,827 B2
(45) Date of Patent: Apr. 22, 2025

(54) AIR CONDITIONER AND CONTROL APPARATUS

(71) Applicant: HISENSE AIR CONDITIONING CO., LTD., Shandong (CN)

(72) Inventors: Qian Chang, Shandong (CN); Jinrui Zhang, Shandong (CN); Shuai Yang, Shandong (CN)

(73) Assignee: HISENSE AIR CONDITIONING CO., LTD., Qingdao (CN)

( * ) Notice: Subject to any disclaimer, the term of this patent is extended or adjusted under 35 U.S.C. 154(b) by 227 days.

(21) Appl. No.: 18/113,515

(22) Filed: Feb. 23, 2023

(65) Prior Publication Data

US 2023/0288111 A1 Sep. 14, 2023

Related U.S. Application Data

(63) Continuation of application No. PCT/CN2021/122014, filed on Sep. 30, 2021.

(30) Foreign Application Priority Data

Sep. 11, 2020 (CN) ..... 202010952795.1

(51) Int. Cl.
*F25B 47/02* (2006.01)
*F25B 13/00* (2006.01)
*F25B 41/20* (2021.01)

(52) U.S. Cl.
CPC ..... *F25B 47/02* (2013.01); *F25B 13/00* (2013.01); *F25B 41/20* (2021.01); *F25B 2313/02741* (2013.01)

(58) Field of Classification Search
CPC ..... F25B 47/02; F25B 13/00; F25B 41/20; F25B 2313/02741; F25B 49/02;
(Continued)

(56) References Cited

U.S. PATENT DOCUMENTS 5,131,455 A 7/1992 Tsuchiyama et al.
2007/0209377 A1 9/2007 Beifus et al.
2020/0166257 A1* 5/2020 Wada ..... F25B 49/005

FOREIGN PATENT DOCUMENTS

CN 105066332 A 11/2015
CN 112283904 A 1/2021

OTHER PUBLICATIONS

International Search Report and Written Opinion dated Dec. 15, 2021 in corresponding International Application No. PCT/CN2021/122014, translated, 18 pages.

* cited by examiner

*Primary Examiner* — Ana M Vazquez
(74) *Attorney, Agent, or Firm* — MH2 TECHNOLOGY LAW GROUP LLP

(57) ABSTRACT

An air conditioner includes: an indoor heat exchanger, an outdoor heat exchanger, an expansion valve, an indoor fan, a compressor, a four-way valve, a temperature control assembly, an outdoor assembly, a signal control assembly, and an indoor assembly. The indoor heat exchanger is configured to exchange heat between indoor air and a refrigerant flowing in the indoor heat exchanger. The outdoor heat exchanger is configured to exchange heat between outdoor air and a refrigerant flowing in the outdoor heat exchanger. The expansion valve is connected between the outdoor heat exchanger and the indoor heat exchanger, and the expansion valve is configured to adjust a pressure of a refrigerant flowing through the outdoor heat exchanger and the indoor heat exchanger, so that a flow rate of the refrigerant flowing through the outdoor heat exchanger and the indoor heat exchanger is adjusted.

20 Claims, 3 Drawing Sheets

(58) Field of Classification Search
CPC ..... F25B 2313/0293; F25B 2313/0294; F24F 11/65; F24F 11/56; F24F 11/64; F24F 11/74; F24F 11/86; F24F 11/88; F24F 2110/10
See application file for complete search history.

AIR CONDITIONER AND CONTROL APPARATUS

CROSS-REFERENCE TO RELATED APPLICATIONS

This application is a continuation application of International Application No. PCT/CN2021/122014, filed on Sep. 30, 2021, which claims priority to Chinese Patent Application No. 202010952795.1, filed on Sep. 11, 2020, which are incorporated herein by reference in their entirety.

TECHNICAL FIELD

The present disclosure relates to the field of air conditioning technologies, and in particular, to an air conditioner and a control apparatus.

BACKGROUND

With the advancement of technologies and the improvement of people's living standards, air conditioners have gradually been used in people's lives and become a necessary product in people's work and life.

A split-type air conditioner includes an indoor unit and an outdoor unit. The indoor unit of the air conditioner is installed indoors, the outdoor unit of the air conditioner is installed outdoors, and the indoor unit and the outdoor unit are connected through pipelines and wires.

SUMMARY

In an aspect, an air conditioner is provided. The air conditioner includes an indoor heat exchanger, an outdoor heat exchanger, an expansion valve, an indoor fan, a compressor, a four-way valve, a temperature control assembly, an outdoor assembly, a signal control assembly and an indoor assembly. The indoor heat exchanger is configured to exchange heat between indoor air and a refrigerant flowing in the indoor heat exchanger. The outdoor heat exchanger is configured to exchange heat between outdoor air and a refrigerant flowing in the outdoor heat exchanger. The expansion valve is connected between the outdoor heat exchanger and the indoor heat exchanger, and the expansion valve is configured to adjust a pressure of a refrigerant flowing through the outdoor heat exchanger and the indoor heat exchanger, so that a flow rate of the refrigerant flowing through the outdoor heat exchanger and the indoor heat exchanger is adjusted. The indoor fan is configured to generate an air flow of the indoor air to promote heat exchange between the refrigerant flowing in the indoor heat exchanger and the indoor air. The compressor is configured to compress the refrigerant flowing through the outdoor heat exchanger and the indoor heat exchanger, and the compressor, the outdoor heat exchanger, the expansion valve, and the indoor heat exchanger are connected sequentially to constitute a refrigerant loop. The four-way valve is configured to switch flowing directions of a refrigerant in the refrigerant loop. The temperature control assembly is configured to output a compressor control signal, a four-way valve control signal, a first fan control signal and a first electrical auxiliary heating control signal. The outdoor assembly is coupled to the temperature control assembly, and the outdoor assembly is configured to control an operation frequency of the compressor according to the compressor control signal, to control four ports of the four-way valve to communicate in pairs according to the four-way valve control signal, and to output a second fan control signal or a third fan control signal. The indoor assembly is coupled to the temperature control assembly, and the indoor assembly is configured to control the air conditioner to operate in an electrical auxiliary heating mode according to the first electrical auxiliary heating control signal. The signal control assembly is coupled to the temperature control assembly, the outdoor assembly and the indoor assembly, and the signal control assembly is configured to transmit one of the first fan control signal, the second fan control signal and the third fan control signal to the indoor assembly, to receive a second electrical auxiliary heating control signal, to transmit the second electrical auxiliary heating control signal to the indoor assembly, and to cut off a transmission of the third fan control signal according to the second electrical auxiliary heating control signal. The indoor assembly is further configured to control a wind speed of the indoor fan to be a first preset wind speed according to one of the first fan control signal and the second fan control signal, to control the wind speed of the indoor fan to be a second preset wind speed according to the third fan control signal, and to control the air conditioner to operate in the electric auxiliary heating mode according to the second electric auxiliary heating control signal; and the first preset wind speed is greater than the second preset wind speed.

In another aspect, a control apparatus is provided, which includes a temperature control assembly, an outdoor assembly, a signal control assembly and an indoor assembly. The temperature control assembly is configured to output a compressor control signal, a four-way valve control signal, a first fan control signal and a first electrical auxiliary heating control signal. The outdoor assembly is coupled to the temperature control assembly, and the outdoor assembly is configured to control an operation frequency of a compressor according to the compressor control signal, to control four ports of a four-way valve to communicate in pairs according to the four-way valve control signal, and to output a second fan control signal or a third fan control signal. The indoor assembly is coupled to the temperature control assembly, and the indoor assembly is configured to control the air conditioner to operate in an electrical auxiliary heating mode according to the first electrical auxiliary heating control signal. The signal control assembly is coupled to the temperature control assembly, the outdoor assembly and the indoor assembly, and the signal control assembly is configured to transmit one of the first fan control signal, the second fan control signal and the third fan control signal to the indoor assembly, to receive a second electrical auxiliary heating control signal, to transmit the second electrical auxiliary heating control signal to the indoor assembly, and to cut off a transmission of the third fan control signal according to the second electrical auxiliary heating control signal. The indoor assembly is further configured to control a wind speed of the indoor fan to be a first preset wind speed according to one of the first fan control signal and the second fan control signal, to control the wind speed of the indoor fan to be a second preset wind speed according to the third fan control signal, and to control the air conditioner to operate in the electric auxiliary heating mode according to the second electric auxiliary heating control signal; and the first preset wind speed is greater than the second preset wind speed.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these accompanying drawings. In addition, the accompanying drawings in the following description may be regarded as schematic diagrams and are not limitations on actual sizes of products, actual processes of methods, and actual timings of signals involved in the embodiments of the present disclosure.

DETAILED DESCRIPTION

Figure 1:
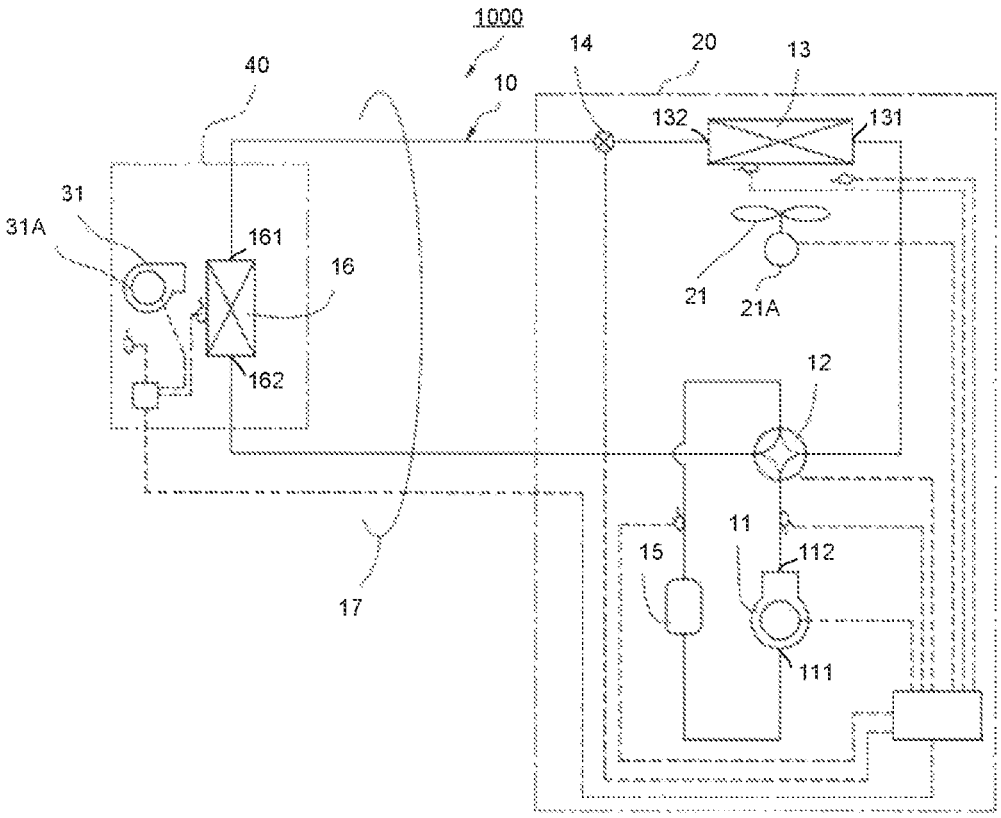
FIG. 1 is a diagram showing a structure of an air conditioner, in accordance with some embodiments.

Technical solutions in the embodiments of the present disclosure will be described clearly and completely below with reference to the accompanying drawings. However, the described embodiments are merely some, but not all, embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as an open and inclusive meaning, i.e., "including, but not limited to." In the description of the specification, the term such as "one embodiment," "some embodiments," "exemplary embodiments," "example," "specific example," or "some examples" is intended to indicate that specific features, structures, materials, or characteristics related to the embodiment(s) or example(s) are included in at least one embodiment or example of the present disclosure. Schematic representation of the above term does not necessarily refer to the same embodiment(s) or example(s). In addition, the specific features, structures, materials or characteristics may be included in any one or more embodiments or examples in any suitable manner.

Hereinafter, the terms such as "first" and "second" are used for descriptive purposes only and are not to be construed as indicating or implying the relative importance or implicitly indicating the number of indicated technical features. Thus, a feature defined with "first" or "second" may explicitly or implicitly include one or more of the features. In the description of the embodiments of the present disclosure, the term "a plurality of" or "the plurality of" means two or more unless otherwise specified.

In the description of some embodiments, the terms "coupled," "connected," and derivatives thereof may be used. For example, the term "connected" may be used in the description of some embodiments to indicate that two or more components are in direct physical or electrical contact with each other. As another example, the term "coupled" may be used in the description of some embodiments to indicate that two or more components are in direct physical or electrical contact with each other. However, the term "coupled" or "communicatively coupled" may also mean that two or more components are not in direct contact with each other, but still cooperate or interact with each other. The embodiments disclosed herein are not necessarily limited to the contents herein.

The phrase "at least one of A, B and C" has the same meaning as the phrase "at least one of A, B or C," and both include the following combinations of A, B and C: only A, only B, only C, a combination of A and B, a combination of A and C, a combination of B and C, and a combination of A, B and C.

The phrase "A and/or B" includes three combinations: only A, only B, and a combination of A and B.

The phrase "applicable to" or "configured to" as used herein indicates an open and inclusive expression, which does not exclude devices that are applicable to or configured to perform additional tasks or steps.

Some embodiments of the present disclosure provide an air conditioner.

As shown in FIG. 1, the air conditioner 1000 includes an indoor unit 40 and an outdoor unit 20. The indoor unit 40 and the outdoor unit 20 are connected by pipelines, so as to transmit a refrigerant. The indoor unit 40 includes an indoor heat exchanger 16, an indoor fan 31, and an indoor fan motor 31A. The outdoor unit 20 includes a compressor 11, a four-way valve 12, an outdoor heat exchanger 13, an outdoor fan 21, an outdoor fan motor 21A, and an expansion valve 14. The air conditioner 1000 further includes a connecting pipe 17. The compressor 11, the outdoor heat exchanger 13, the expansion valve 14, and the indoor heat exchanger 16 are connected sequentially through the connecting pipe 17, so as to constitute a refrigerant loop 10. The refrigerant circulates in the refrigerant loop 10 and exchanges heat with air through the outdoor heat exchanger 13 and the indoor heat exchanger 16, thus achieving a cooling mode or a heating mode of the air conditioner 1000.

The compressor 11 is configured to compress a refrigerant, so that a low-pressure refrigerant is compressed to be a high-pressure refrigerant.

In some embodiments, as shown in FIG. 1, the outdoor unit 20 further includes a liquid accumulator 15. The liquid accumulator 15 is disposed between the outdoor heat exchanger 13 and a suction port 111 of the compressor 11. In the liquid accumulator 15, a refrigerant flowing from the outdoor heat exchanger 13 to the compressor 11 is separated into a gas refrigerant and a liquid refrigerant. Moreover, the gas refrigerant is mainly supplied from the liquid accumulator 15 to the suction port 111 of the compressor 11.

The outdoor heat exchanger 13 is configured to exchange heat between outdoor air and a refrigerant flowing in the outdoor heat exchanger 13. For example, the outdoor heat exchanger 13 operates as a condenser in the cooling mode, so that the refrigerant compressed by the compressor 11 is condensed by dissipating heat into the outdoor air through the outdoor heat exchanger 13. The outdoor heat exchanger 13 operates as an evaporator in the heating mode, so that the decompressed refrigerant is evaporated by absorbing heat from the outdoor air through the outdoor heat exchanger 13.

In some embodiments, as shown in FIG. 1, the outdoor heat exchanger 13 has a first in-out port 131, and the refrigerant flows from the first in-out port 131 of the outdoor heat exchanger 13 to the suction port 111 of the compressor 11 via the liquid accumulator 15. For example, as shown in FIG. 1, the outdoor heat exchanger 13 further has a second in-out port 132, and a refrigerant flows from the second in-out port 132 of the outdoor heat exchanger 13 to the expansion valve 14, or a refrigerant flows from the expansion valve 14 to the second in-out port 132 of the outdoor heat exchanger 13.

In some embodiments, the outdoor heat exchanger 13 further includes heat exchange fins. Therefore, it may be possible to expand a contact area between the outdoor air and the refrigerant flowing in the outdoor heat exchanger 13, and in turn improve heat exchange efficiency between the outdoor air and the refrigerant.

The outdoor fan 21 is configured to suck the outdoor air into the outdoor unit 20 through an outdoor air inlet of the outdoor unit 20, and to send the outdoor air, which has exchanged heat with the refrigerant flowing in the outdoor heat exchanger 13, out through an outdoor air outlet of the outdoor unit 20. The outdoor fan 21 provides power for the flow of the outdoor air.

The outdoor fan motor 21A is a variable speed motor, and the outdoor fan motor 21A is configured to drive the outdoor fan 21 to rotate.

The expansion valve 14 is connected between the outdoor heat exchanger 13 and the indoor heat exchanger 16. A pressure of a refrigerant flowing through the outdoor heat exchanger 13 and the indoor heat exchanger 16 is adjusted by adjusting a magnitude of an opening degree of the expansion valve 14, so that a flow rate of the refrigerant flowing through the outdoor heat exchanger 13 and the indoor heat exchanger 16 is adjusted. The flow rate and pressure of the refrigerant flowing through the outdoor heat exchanger 13 and the indoor heat exchanger 16 have an influence on the heat exchange performance of the outdoor heat exchanger 13 and the heat exchange performance of the indoor heat exchanger 16. The expansion valve 14 may be an electronic valve. The opening degree of the expansion valve 14 is adjustable, so that the flow and pressure of the refrigerant flowing through the expansion valve 14 may be controlled.

By reducing the opening degree of the expansion valve 14, a flow resistance of the refrigerant flowing through the expansion valve 14 is increased. By increasing the opening degree of the expansion valve 14, the flow resistance of the refrigerant flowing through the expansion valve 14 is decreased.

The four-way valve 12 is connected in the refrigerant loop 10. The four-way valve 12 is configured to switch flowing directions of the refrigerant in the refrigerant loop 10, so that the operation mode of the air conditioner 1000 is switched between the cooling mode and the heating mode.

The indoor heat exchanger 16 is configured to exchange heat between the indoor air and a refrigerant flowing in the indoor heat exchanger 16. For example, the indoor heat exchanger 16 operates as an evaporator in the cooling mode, so that the refrigerant, which has been dissipated heat by the outdoor heat exchanger 13, is evaporated by absorbing heat from the indoor air through the indoor heat exchanger 16. The indoor heat exchanger 16 operates as a condenser in the heating mode, so that the refrigerant, which has absorbed heat through the outdoor heat exchanger 13, is condensed by dissipating heat into the indoor air through the indoor heat exchanger 16.

For example, as shown in FIG. 1, the indoor heat exchanger 16 has a third in-out port 161, and a liquid refrigerant flows from the third in-out port 161 of the indoor heat exchanger 16 to the expansion valve 14, or the liquid refrigerant flows from the expansion valve 14 to the third in-out port 161 of the indoor heat exchanger 16. For example, as shown in FIG. 1, the indoor heat exchanger 16 further has a fourth in-out port 162, and a gas refrigerant flows from a discharge port 112 of the compressor 11 to the fourth in-out port 162 of the indoor heat exchanger 16.

In some embodiments, the indoor heat exchanger 16 further includes heat exchange fins. In this way, it may be possible to expand a contact area between the indoor air and the refrigerant flowing in the indoor heat exchanger 16 and in turn improve a heat exchange efficiency between the indoor air and the refrigerant.

The indoor fan 31 is configured to suck the indoor air into the indoor unit 40 through an indoor air inlet of the indoor unit 40 and to send the indoor air, which has exchanged heat with the refrigerant flowing in the indoor heat exchanger 16, out through an indoor air outlet of the indoor unit 40. The indoor fan 31 generates an air flow of indoor air flowing through the indoor heat exchanger 16 to promote heat-exchange between the refrigerant flowing in the indoor heat exchanger 16 and the indoor air. The indoor fan 31 provides power for the flow of the indoor air.

The indoor fan motor 31A is a variable speed motor, and the indoor fan motor 31A is configured to drive the indoor fan 31 to rotate.

Figure 3:
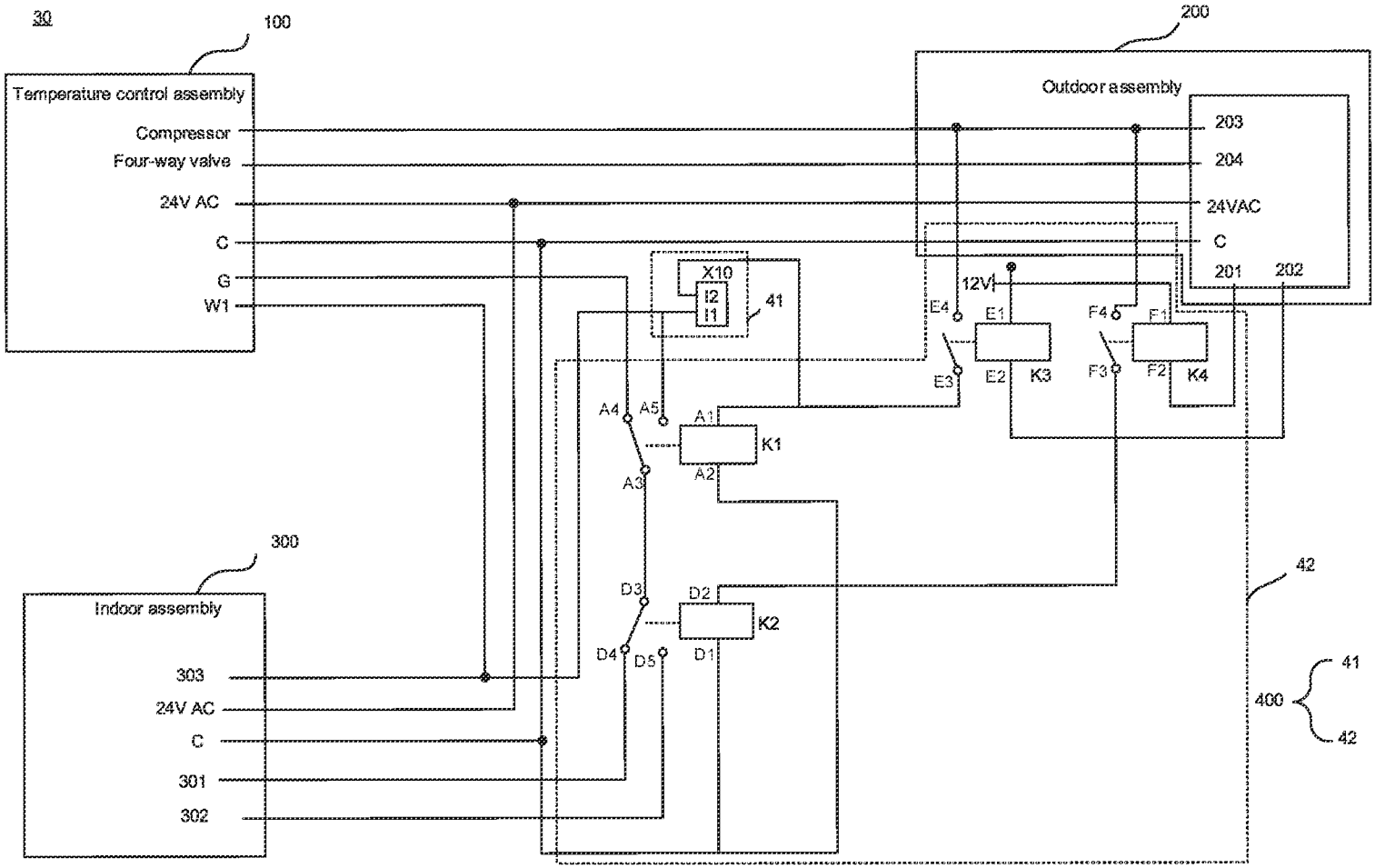
FIG. 3 is a circuit diagram of another control apparatus, in accordance with some embodiments.

In some examples, as shown in FIG. 3, a control apparatus 30 of the air conditioner includes a temperature control assembly 100, an outdoor assembly 200, an indoor assembly 300, and a signal control assembly 400. The signal control assembly 400 includes an electrical auxiliary heating signal controller 41 and a fan signal controller 42. The electrical auxiliary heating signal controller 41 is coupled to the indoor assembly 300, and the electrical auxiliary heating signal controller 41 is configured to transmit a second electrical auxiliary heating control signal output by the user to the indoor assembly 300. The fan signal controller 42 is coupled to the temperature control assembly 100, the outdoor assembly 200, and the indoor assembly 300.

For example, as shown in FIG. 3, the fan signal controller 42 includes a first relay K1, a second relay K2, a third relay K3 and a fourth relay K4.

For example, as shown in FIG. 3, the temperature control assembly 100, the outdoor assembly 200, and the indoor assembly 300 each include a common terminal C, and common terminals C of the temperature control assembly 100, the outdoor assembly 200, and the indoor assembly 300 are coupled to each other. The temperature control assembly 100 includes an electric auxiliary heating control terminal W1 and a fan control terminal G. The indoor assembly 300 includes a first preset wind speed control terminal 301 and a second preset wind speed control terminal 302. The outdoor assembly 200 includes a first outdoor unit control terminal 201 and a second outdoor unit control terminal 202.

A first terminal A1 of a coil of the first relay K1 and a second terminal I2 of a wired controller X10 are both coupled to a first terminal E3 of a switch of the third relay K3, a second terminal A2 of the coil of the first relay K1 and a first terminal D1 of a coil of the second relay K2 are both coupled to the common terminal C, a first terminal A5 of a switch of the first relay K1 and a first terminal I1 of the wired controller X10 are both coupled to the electric auxiliary heating control terminal W1 of the temperature control assembly 100. A second terminal A4 of the switch of the first relay K1 is coupled to the fan control terminal G of the temperature control assembly 100, and a third terminal A3 of the switch of the first relay K1 is coupled to a third terminal D3 of a switch of the second relay K2.

A second terminal D2 of the coil of the second relay K2 is coupled to a first terminal F3 of a switch of the fourth relay K4, a first terminal D5 of the switch of the second relay K2 is coupled to a second preset wind speed control terminal 302 of the indoor assembly 300, and a second terminal D4 of the switch of the second relay K2 is coupled to a first preset wind speed control terminal 301 of the indoor assembly 300.

A second terminal E4 of the switch of the third relay K3 is coupled to a transmission path of a compressor control signal, a first terminal E1 of a coil of the third relay K3 and a first terminal F1 of a coil of the fourth relay K4 are both coupled to a power supply (e.g., a power supply with a voltage of 12 V), and a second terminal E2 of the coil of the third relay K3 is coupled to a second outdoor unit control terminal 202 of the outdoor assembly 200. A second terminal F2 of the coil of the fourth relay K4 is coupled to a first outdoor unit control terminal 201 of the outdoor assembly 200, and a second terminal F4 of the switch of the fourth relay K4 is coupled to the transmission path 501 of the compressor control signal.

When the outdoor unit enters a defrosting state, the indoor heat exchanger operates as a condenser, and the outdoor heat exchanger operates as an evaporator, so as to remove frost on a surface of the outdoor heat exchanger. By receiving a compressor operation signal, the control apparatus controls the indoor fan of the indoor unit to operate, and controls the air conditioner to operate in an electric auxiliary heating mode. Operation modes of the control apparatus include an electric auxiliary heating mode and non-electric auxiliary heating mode. In a case where the air conditioner further includes an electric heater (e.g., a ceramic heater), the electric heater is disposed proximate to the indoor air outlet of the indoor unit, and the air blown out of the indoor air outlet is heated by the electric heater, the air conditioner operates in the electric auxiliary heating mode. In a case where there is no electric heater in the air conditioner, or the electric heater included in the air conditioner is disposed proximate to the indoor air outlet of the air conditioner but does not operate, and the air blown out of the indoor air outlet is not heated by the electric heater, the air conditioner operates in a non-electric auxiliary heating mode. By receiving the second electrical auxiliary heating control signal, the wired controller X10 of the indoor unit is turned on, so that the first terminal I1 and the second terminal I2 of the wired controller X10 are short-circuited; for example, the second electrical auxiliary heating control signal is triggered by the user; the outdoor assembly 200 controls the third relay K3 to be on; and in this case, the relay K1 is on by energizing the coil of the relay K1, the electric heater operates, and the wind speed of the indoor fan is a first preset wind speed (e.g., a high wind speed), and the air conditioner is in the electric auxiliary heating mode. In a case where the outdoor assembly 200 controls the relay K3 to be on, the relay K1 is on by energizing the coil of the relay K1, and the indoor fan stops operating, and the air conditioner is in the non-electric auxiliary heating mode.

In a case where the air conditioner operates in a mode except for the defrosting mode, there is no need to transmit a defrosting signal to the indoor unit. In this case, the outdoor assembly 200 may control the wind speed of the indoor fan to be the first preset wind speed or a second preset wind speed (e.g., a low wind speed) by controlling the relay K4 and the relay K2 to be off or on, according to an operation frequency of the compressor 11 of the outdoor unit. A communication mode between the temperature control assembly 100 and the outdoor assembly 200 is a unidirectional communication mode, and a communication mode between the temperature control assembly 100 and the indoor assembly 300 is a unidirectional communication mode. That is, the temperature control assembly 100 outputs signals to the outdoor assembly 200 and the indoor assembly 300, and the temperature control assembly 100 does not receive signals output by the outdoor assembly 200 and the indoor assembly 300.

The temperature control assembly 100 adopts a public communication protocol, sends the compressor control signal to the outdoor assembly 200 through a compressor control signal terminal 203 and sends a four-way valve control signal to the outdoor assembly 200 through a four-way valve control signal terminal 204, so that the outdoor assembly 200 controls the compressor to operate according to the compressor control signal and controls the four-way valve to operate according to the four-way valve control signal. The temperature control assembly 100 sends an electric auxiliary heating start signal to the indoor assembly 300 through an electric auxiliary heating start signal terminal 303, and sends a fan start signal to the indoor assembly 300, so that the indoor assembly 300 controls the indoor fan to operate according to the fan start signal and controls the electric heater to operate according to the electric auxiliary heating start signal. In a case where the electric heater is turned on, if the outdoor assembly 200 does not control the indoor fan to operate synchronously or the outdoor assembly 200 controls the wind speed of the indoor fan to be a low wind speed, then heat generated by the electric heater cannot be dissipated by the indoor fan in time, and the electric heater may be easily damaged due to an excessive temperature.

Figure 2:
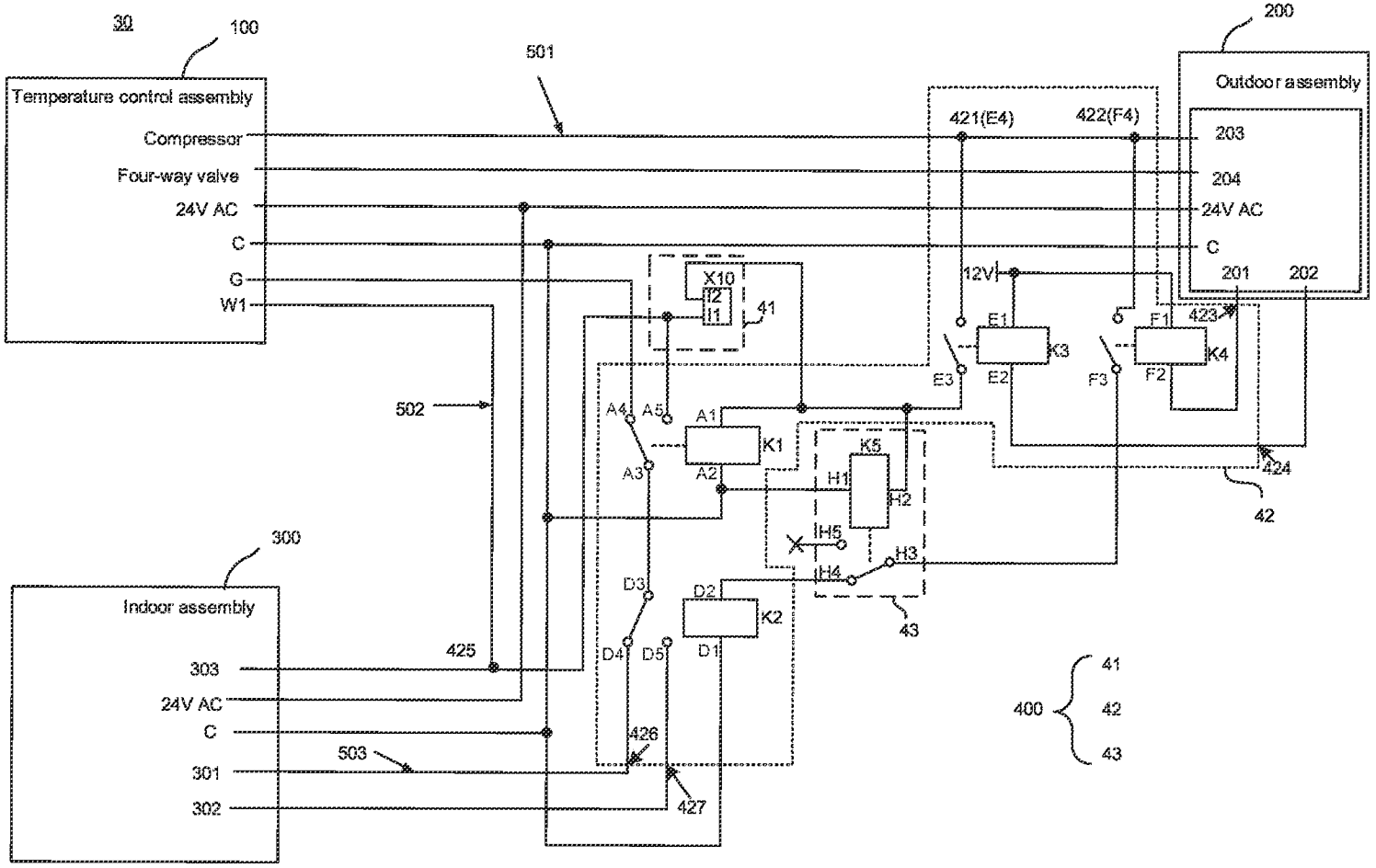
FIG. 2 is a circuit diagram of a control apparatus, in accordance with some embodiments.

In some embodiments, as shown in FIG. 2, the air conditioner 1000 further includes a control apparatus 30. The control apparatus 30 is configured to control the operation frequency of the compressor 11, the opening degree of the expansion valve 14, a rotation speed of the outdoor fan 21, and a rotation speed of the indoor fan 31. The control apparatus 30 is coupled to the compressor 11, the expansion valve 14, the outdoor fan 21, and the indoor fan 31 through data lines, so as to transmit communication information.

The control apparatus 30 includes a fifth relay K5, and the fifth relay K5 is coupled to an electric auxiliary heating signal controller 41. In a case where an electric heater included in the control apparatus 30 operates but the indoor fan does not operate or the wind speed of the indoor fan is a low wind speed, a coil of the fifth relay K5 is energized, so that the coil of the second relay K2 is powered off. In this way, the wind speed of the indoor fan 31 is from zero to the high wind speed, or the wind speed of the indoor fan 31 is from the low wind speed to the high wind speed. The wind speed of the indoor fan 31 cannot be a low wind speed afterwards, but can only be a high wind speed, which prevents the electric heater from being damaged due to the excessive temperature.

The control apparatus 30 includes a processor. The processor may include a central processing unit (CPU), a microprocessor, or an application specific integrated circuit (ASIC), and may be configured to perform the corresponding operations described with reference to the control apparatus 30 when the processor executes a program stored in a non-transitory computer readable media coupled to the control apparatus 30. The non-transitory computer-readable storage media may include a magnetic storage device (e.g., a hard disk, a floppy disk or a magnetic tape), a smart card, or a flash memory device (e.g., an erasable programmable read-only memory (EPROM), a card, a stick, or a keyboard driver).

In some embodiments, as shown in FIG. 2, the control apparatus 30 includes a temperature control assembly 100, an outdoor assembly 200, an indoor assembly 300, and a signal control assembly 400.

The temperature control assembly 100 is configured to output a compressor control signal and a four-way valve control signal to the outdoor assembly 200, and to output a first fan control signal (e.g., a first fan control signal output by a fan control terminal G of the temperature control assembly 100 in FIG. 2) and a first electrical auxiliary heating control signal (e.g., a first electrical auxiliary heating control signal output by an electric auxiliary heating control terminal W1 of the temperature control assembly 100 in FIG. 2) to the indoor assembly 300.

The outdoor assembly 200 is configured to control the operation frequency of the compressor 11 according to the compressor control signal and to control four ports of the four-way valve 12 to communicate in pairs according to the four-way valve control signal. The outdoor assembly 200 is further configured to output a second fan control signal and a third fan control signal.

The indoor assembly 300 is configured to control the wind speed of the indoor fan 31 to be the first preset wind speed according to the first fan control signal or the second fan control signal, to control the wind speed of the indoor fan 31 to be the second preset wind speed according to the third fan control signal, and to turn on the electric heater according to the first electric auxiliary heating control signal or the second electric auxiliary heating control signal. It will be noted that the first preset wind speed is greater than the second preset wind speed.

The signal control assembly 400 is configured to transmit the first fan control signal, the third fan control signal, and a second electrical auxiliary heating control signal to the indoor assembly 300, and to transmit the second fan control signal to the indoor assembly 300 according to the second electrical auxiliary heating signal. For example, the second electrical auxiliary heating control signal is triggered by the user. As shown in FIG. 2, the indoor assembly 300 includes a first preset wind speed control terminal 301 and a second preset wind speed control terminal 302. The first fan control signal and the second fan control signal are transmitted to the first preset wind speed control terminal 301, and the third fan control signal is transmitted to the second preset wind speed control terminal 302.

In some embodiments, as shown in FIG. 2, the signal control assembly 400 includes an electrical auxiliary heating signal controller 41, a fan signal controller 42, and an electrical auxiliary heating protector 43.

The electrical auxiliary heating signal controller 41 is coupled to the indoor assembly 300, and the electrical auxiliary heating signal controller 41 is configured to transmit the second electrical auxiliary heating control signal to the indoor assembly 300.

The fan signal controller 42 is coupled to the temperature control assembly 100, the outdoor assembly 200, and the indoor assembly 300. The fan signal controller 42 is configured to: transmit one of the first fan control signal, the second fan control signal and the third fan control signal to the indoor assembly 300. In some examples, the fan signal controller 42 is configured to transmit the first fan control signal or the second fan control signal to the indoor assembly 300 according to the second electrical auxiliary heating control signal.

The electric auxiliary heating protector 43 is coupled to the electric auxiliary heating signal controller 41, and the electrical auxiliary heating protector 43 and the fan signal controller 42 are configured to stop a transmission of the third fan control signal according to the second electrical auxiliary heating control signal.

In some embodiments, as shown in FIG. 2, the fan signal controller 42 includes a first input terminal 421, a second input terminal 422, a third input terminal 423, a fourth input terminal 424, a first output terminal 425, a second output terminal 426 and a third output terminal 427. The outdoor assembly 200 includes a first outdoor unit control terminal 201 and a second outdoor unit control terminal 202. The first input terminal 421 and the second input terminal 422 of the fan signal controller 42 are coupled to a transmission path of the compressor control signal, the third input terminal 423 of the fan signal controller 42 is coupled to the first outdoor unit control terminal 201 of the outdoor assembly 200, and the fourth input terminal 424 of the fan signal controller 42 is coupled to the second outdoor unit control terminal 202 of the outdoor assembly 200. The first output terminal 425 of the fan signal controller 42 is coupled to a transmission path 502 of the first electrical auxiliary heating control signal, the second output terminal 426 of the fan signal controller 42 is coupled to the first preset wind speed control terminal 301 of the indoor assembly 300, and the third output terminal 427 of the fan signal controller 42 is coupled to the second preset wind speed control terminal 302 of the indoor assembly 300.

In some embodiments, as shown in FIG. 2, the electric auxiliary heating signal controller 41 includes a wired controller X10, and the wired controller X10 is configured to be controlled according to the second electrical auxiliary heating control signal, so that the first terminal I1 and second terminal I2 of the wired-controller X10 are short-circuited. For example, the second electrical auxiliary heating control signal is triggered by the user.

In some embodiments, as shown in FIG. 2, the fan signal controller 42 further includes a first relay K1, a second relay K2, a third relay K3 and a fourth relay K4. The electric auxiliary heating protector 43 includes a fifth relay K5. In this way, the accuracy of control of the outdoor unit on the indoor unit may be improved.

In some embodiments, as shown in FIG. 2, the temperature control assembly 100, the outdoor assembly 200, and the indoor assembly 300 each include a common terminal C, and common terminals C of the temperature control assembly 100, the outdoor assembly 200, and the indoor assembly 300 are coupled to each other. A first terminal A1 of a coil of the first relay K1 and the second terminal I2 of the wired controller X10 are both coupled to a first terminal E3 of a switch of the third relay K3, a second terminal A2 of the coil of the first relay K1 and a first terminal H1 of a coil of the fifth relay K5 are both coupled to the common terminal C, and a first terminal A5 of a switch of the first relay K1 and the first terminal I1 of the wired controller X10 are both coupled to the first output terminal 425 of the fan signal controller 42. A second terminal A4 of a switch of the first relay K1 is coupled to a transmission path 503 of the first fan control signal (for example, the second terminal A4 of the switch of the first relay K1 is coupled to the fan control terminal G of the temperature control assembly 100), and a third terminal A3 of the switch of the first relay K1 is coupled to a third terminal D3 of a switch of the second relay K2, to transmit the first fan control signal and the second fan control signal.

A first terminal D1 of a coil of the second relay K2 is coupled to the common terminal C, a second terminal D2 of the coil of the second relay K2 is coupled to a second terminal H4 of a switch of the fifth relay K5, a first terminal D5 of the switch of the second relay K2 is coupled to the third output terminal 427 of the fan signal controller 42, and a second terminal D4 of the switch of the second relay K2 is coupled to the second output terminal 426 of the fan signal controller 42.

A second terminal H2 of the coil of the fifth relay K5 is coupled to the first terminal E3 of the switch of the third relay K3, a first terminal H5 of the switch of the fifth relay K5 is in a disconnected state, and a third terminal H3 of the switch of the fifth relay K5 is coupled to a first terminal F3 of a switch of the fourth relay K4.

A second terminal E4 of the switch of the third relay K3 is coupled to the first input terminal 421 of the fan signal controller 42, a first terminal E1 of a coil of the third relay K3 and a first terminal F1 of a coil of the fourth relay K4 are both coupled to a power supply (e.g., a power supply with a voltage of 12 V), and a second terminal E2 of the coil of the third relay K3 is the fourth input terminal 424 of the fan signal controller 42. A second terminal F2 of the coil of the fourth relay K4 is the third input terminal 423 of the fan signal controller 42, and a second terminal F4 of the switch of the fourth relay K4 is coupled to the second input terminal 422 of the fan signal controller 42.

The switch of the third relay K3 and the switch of the fourth relay K4 are normally open single-pole single-throw switches, and the switch of the first relay K1, the switch of the second relay K2, and the switch of the fifth relay K5 are single-pole double-throw switches.

TABLE 1

| Operation mode | K3 | K4 | X10 | Wind speed |
|---|---|---|---|---|
| Electric auxiliary heating and defrosting | On | Off | On | High |
| Non-electric auxiliary heating and defrosting | On | Off | Off | Zero |
| Electric auxiliary heating and non-defrosting | Off | Off | On | High |
| Non-electricity auxiliary heating and non-defrosting | Off | On | Off | Low |

Table 1 shows relationships between different operation modes of the air conditioner, states of switches of the third relay K3 and the fourth relay K4, the state of the wired controller X10, and the wind speed. As shown in Table 1, if the air conditioner 1000 is in the electric auxiliary heating mode and the defrosting mode, the first terminal I1 and the second terminal I2 of the wired controller X10 are short-circuited; and the outdoor assembly 200 is configured to control the switch of the third relay K3 to be closed and the switch of the fourth relay K4 to be opened according to the defrosting signal. In this way, the first terminal A5 and the third terminal A3 of the switch of the first relay K1 are connected, the first terminal H5 and the third terminal H3 of the switch of the fifth relay K5 are connected, and the second terminal D4 and the third terminal D3 of the switch of the second relay K2 are connected, so as to output the second fan control signal and the second electrical auxiliary heating control signal to the indoor assembly 300. As a result, the indoor fan 31 is powered by the indoor unit, the wind speed of the indoor fan 31 is the first preset wind speed, and the electric heater is powered on through the wired controller X10. In this case, the coil of the fifth relay K5 is energized, so that the coil of the second relay K2 is powered off. Thus, the wind speed of the indoor fan 31 cannot be a low wind speed, which may avoid a problem that the electric heater is easily damaged due to the excessive temperature.

If the air conditioner 1000 is in the non-electric auxiliary heating mode and is in the defrosting mode (that is, the air conditioner 1000 is in the defrosting mode but is not in the electric auxiliary heating mode), the wired controller X10 is off; and the outdoor assembly 200 is configured to control the switch of the third relay K3 to be closed and the switch of the fourth relay K4 to be opened according to the defrosting signal. Therefore, the first terminal A5 and the third terminal A3 of the switch of the first relay K1 are connected, the first terminal H5 and the third terminal H3 of the switch of the fifth relay K5 are connected, and the second terminal D4 and the third terminal D3 of the switch of the second relay K2 are connected. As a result, the transmissions of the first fan control signal, the second fan control signal, and the third fan control signal of the indoor fan 31 are cut off, and the indoor fan 31 stops operating.

If the air conditioner 1000 is in the electric auxiliary heating mode and the non-defrosting mode (that is, the air conditioner 1000 is in the electric auxiliary heating mode but is not in the defrosting mode), and the frequency of the compressor 11 is greater than a first preset frequency, the first terminal I1 and the second terminal I2 of the wired controller X10 are short-circuited, and the outdoor assembly 200 is configured to control the switch of the third relay K3 and the switch of the fourth relay K4 to be opened. Therefore, the second terminal A4 and the third terminal A3 of the switch of the first relay K1 are connected, and the second terminal D4 and the third terminal D3 of the switch of the second relay K2 are connected. As a result, the second fan control signal and the second electrical auxiliary heating control signal are transmitted to the indoor assembly 300, the wind speed of the indoor fan 31 is the first preset wind speed, and the electric heater is turned on. In a case where the air conditioner 1000 is in the electric auxiliary heating mode and the compressor 11 operates at a high frequency, the air conditioner 1000 outputs a wind with a high wind speed, which is conducive to improving the heating efficiency of the air conditioner 1000. Although the outdoor assembly 200 controls the fourth relay K4 to be closed, the coil of the fifth relay K5 is immediately energized after the first terminal and second terminal of the wired controller X10 are short-circuited, the first terminal H5 and the third terminal H3 of the switch of the fifth relay K5 are connected, and the coil of the second relay K2 is powered off. Therefore, the second relay K2 cannot operate, the second terminal D4 and the third terminal D3 of the second relay K2 are connected, and the wind speed of the indoor fan 31 cannot be a low wind speed and is a high wind speed, which may prevent the electric heater from drying out.

If the air conditioner 1000 is not in the electric auxiliary heating mode and the defrosting mode, and the frequency of the compressor 11 is lower than a second preset frequency, the wired controller X10 is off, and the outdoor assembly 200 is configured to control the switch of the third relay K3 to be opened and the switch of the fourth relay K4 to be closed. Therefore, the second terminal A4 and the third terminal A3 of the switch of the first relay K1 are connected, the first terminal D5 and the third terminal D3 of the switch of the second relay K2 are connected, and the second terminal H4 and the third terminal H3 of the switch of the fifth relay K5 are connected. As a result, the third fan control signal is transmitted to the indoor assembly 300, and the wind speed of the indoor fan 31 is the second preset wind speed. In a case where the air conditioner 1000 does not have the electric auxiliary heating function and the compressor 11 operates at a low frequency, the air conditioner 1000 outputs a wind with a low wind speed, which is conducive to reducing the power consumption of the air conditioner 1000 and improving the energy efficiency of the air conditioner

1000. In a case where the outdoor assembly 200 does not output a control signal, the coil of the fifth relay K5 is not energized, and the second terminal H4 and the third terminal H3 of the fifth relay K5 are connected. As a result, the operation of the second relay K2 may not be affected. It will be noted that the first preset frequency is greater than the second preset frequency.

In some embodiments, the power supply terminals of the temperature control assembly 100, the outdoor assembly 200, and the indoor assembly 300 are all coupled to a 24 V alternating current (AC) power supply, so as to improve the stability of the power supply of the air conditioner 1000.

The air conditioner includes a processor, a memory, and a control program of the air conditioner that is stored in the memory and is executable on the processor.

The foregoing descriptions are merely specific implementations of the present disclosure, but the protection scope of the present disclosure is not limited thereto. Any person skilled in the art could conceive of changes or replacements within the technical scope of the present disclosure, which shall all be included in the protection scope of the present disclosure. Therefore, the protection scope of the present disclosure shall be subject to the protection scope of the claims.

What is claimed is:

1. An air conditioner, comprising:

an indoor heat exchanger configured to exchange heat between indoor air and a refrigerant flowing in the indoor heat exchanger;

an outdoor heat exchanger configured to exchange heat between outdoor air and a refrigerant flowing in the outdoor heat exchanger;

an expansion valve connected between the outdoor heat exchanger and the indoor heat exchanger, wherein the expansion valve is configured to adjust a pressure of a refrigerant flowing through the outdoor heat exchanger and the indoor heat exchanger, so that a flow rate of the refrigerant flowing through the outdoor heat exchanger and the indoor heat exchanger is adjusted;

an indoor fan configured to generate an air flow of the indoor air to promote heat exchange between the refrigerant flowing in the indoor heat exchanger and the indoor air;

a compressor configured to compress the refrigerant flowing through the outdoor heat exchanger and the indoor heat exchanger, wherein the compressor, the outdoor heat exchanger, the expansion valve, and the indoor heat exchanger are connected sequentially to constitute a refrigerant loop;

a four-way valve configured to switch flowing directions of a refrigerant in the refrigerant loop;

a temperature control assembly configured to output a compressor control signal, a four-way valve control signal, a first fan control signal, and a first electrical auxiliary heating control signal;

an outdoor assembly coupled to the temperature control assembly, wherein the outdoor assembly is configured to control an operation frequency of the compressor according to the compressor control signal, to control four ports of the four-way valve to communicate in pairs according to the four-way valve control signal, and to output a second fan control signal or a third fan control signal;

an indoor assembly coupled to the temperature control assembly, wherein the indoor assembly is configured to control the air conditioner to operate in an electrical auxiliary heating mode according to the first electrical auxiliary heating control signal; and a signal control assembly coupled to the temperature control assembly, the outdoor assembly and the indoor assembly, wherein the signal control assembly is configured to transmit one of the first fan control signal, the second fan control signal, and the third fan control signal to the indoor assembly, to receive a second electrical auxiliary heating control signal, to transmit the second electrical auxiliary heating control signal to the indoor assembly, and to cut off a transmission of the third fan control signal according to the second electrical auxiliary heating control signal;

wherein the indoor assembly is further configured to control a wind speed of the indoor fan to be a first preset wind speed according to one of the first fan control signal and the second fan control signal, to control the wind speed of the indoor fan to be a second preset wind speed according to the third fan control signal, and to control the air conditioner to operate in the electrical auxiliary heating mode according to the second electric auxiliary heating control signal; and wherein the first preset wind speed is greater than the second preset wind speed.

2. The air conditioner according to claim 1, wherein the signal control assembly includes:

an electrical auxiliary heating signal controller coupled to the indoor assembly, wherein the electrical auxiliary heating signal controller is configured to transmit the second electrical auxiliary heating control signal to the indoor assembly;

a fan signal controller coupled to the temperature control assembly, the outdoor assembly, and the indoor assembly, wherein the fan signal controller is configured to transmit one of the first fan control signal, the second fan control signal, and the third fan control signal to the indoor assembly; and an electrical auxiliary heating protector coupled to the electrical auxiliary heating signal controller, wherein the electric auxiliary heating protector is configured to disconnect a transmission path of the third fan control signal according to the second electric auxiliary heating control signal.

3. The air conditioner according to claim 2, wherein the fan signal controller is configured to transmit the first fan control signal or the second fan control signal to the indoor assembly according to the second electrical auxiliary heating control signal.

4. The air conditioner according to claim 2, wherein the outdoor assembly includes a first outdoor unit control terminal and a second outdoor unit control terminal, and the indoor assembly includes a first preset wind speed control terminal and a second preset wind speed control terminal; and the fan signal controller includes:

a first input terminal coupled to a transmission path of the compressor control signal;

a second input terminal coupled to the transmission path of the compressor control signal;

a third input terminal coupled to the first outdoor unit control terminal of the outdoor assembly;

a fourth input terminal coupled to the second outdoor unit control terminal of the outdoor assembly;

a first output terminal coupled to a transmission path of the first electrical auxiliary heating control signal;

a second output terminal coupled to the first preset wind speed control terminal of the indoor assembly; and a third output terminal coupled to the second preset wind speed control terminal of the indoor assembly.

5. The air conditioner according to claim 4, wherein the electrical auxiliary heating signal controller includes:

a wired controller configured to control a first terminal and a second terminal of the wired controller to be short-circuited according to the second electrical auxiliary heating control signal;

the fan signal controller further includes:

a first relay, wherein a first terminal of a switch of the first relay and the first terminal of the wired controller are both coupled to the first output terminal, a second terminal of the switch of the first relay is coupled to a transmission path of the first fan control signal, and a third terminal of the switch of the first relay is coupled to a third terminal of a switch of the second relay;

a second relay, wherein a first terminal of a coil of the second relay is configured to be coupled to a common terminal, a first terminal of a switch of the second relay is coupled to the third output terminal, and a second terminal of the switch of the second relay is coupled to the second output terminal;

a third relay, wherein a second terminal of a switch of the third relay is the first input terminal, a second terminal of a coil of the third relay is coupled to the fourth input terminal, and a first terminal of a coil of the first relay and the second terminal of the wired controller are both coupled to a first terminal of the switch of the third relay; and a fourth relay, wherein a second terminal of a coil of the fourth relay is used as the third input terminal, the first terminal of the coil of the third relay and a first terminal of the coil of the fourth relay are each configured to be coupled to a power supply, and a second terminal of a switch of the fourth relay is coupled to the second input terminal;

the electric auxiliary heating protector includes:

a fifth relay, wherein a second terminal of a coil of the fifth relay is coupled to the first terminal of the switch of the third relay, a first terminal of a switch of the fifth relay is in a disconnected state, a third terminal of the switch of the fifth relay is coupled to a first terminal of the switch of the fourth relay, a second terminal of the switch of the fifth relay is coupled to a second terminal of the coil of the second relay, and a second terminal of the coil of the first relay and a first terminal of the coil of the fifth relay are both coupled to the common terminal.

6. The air conditioner according to claim 5, wherein the outdoor assembly is further configured to: when the first terminal and the second terminal of the wired controller are short-circuited, receive a defrosting signal, and control the switch of the third relay to be closed and the switch of the fourth relay to be opened according to the defrosting signal, so that the first terminal and the third terminal of the switch of the first relay are connected, the first terminal and the third terminal of the switch of the fifth relay are connected, and the second terminal and the third terminal of the switch of the second relay are connected; so as to output the second fan control signal and the second electric auxiliary heating control signal to the indoor assembly; and wherein the electric auxiliary heating signal controller is configured to be powered on through the wired controller.

7. The air conditioner according to claim 5, wherein the outdoor assembly is further configured to: when the wired controller is off, receive a defrosting signal, and control the switch of the third relay to be closed and the switch of the fourth relay to be opened according to the defrosting signal, so that the first terminal and the third terminal of the switch of the first relay are connected, the first terminal and the third terminal of the switch of the fifth relay are connected, and the second terminal and the third terminal of the switch of the second relay are connected.

8. The air conditioner according to claim 5, wherein the outdoor unit is further configured to: when a frequency of the compressor is greater than a first preset frequency and the first terminal and the second terminal of the wired controller are short-circuited, control the switch of the third relay and the switch of the fourth relay to be opened, so that the second terminal and the third terminal of the switch of the first relay are connected, and the second terminal and the third terminal of the switch of the second relay are connected, so as to output the second fan control signal and the second electric auxiliary heating control signal to the indoor assembly; and wherein the electric auxiliary heating signal controller is configured to be powered on through the wired controller.

9. The air conditioner according to claim 5, wherein the outdoor unit is further configured to: when a frequency of the compressor is less than a second preset frequency and the wired controller is off, control the switch of the third relay to be opened and the switch of the fourth relay to be closed, so that the second terminal and the third terminal of the switch of the first relay are connected, the first terminal and the third terminal of the switch of the second relay are connected, and the second terminal and the third terminal of the switch of the fifth relay are connected, so as to output the third fan control signal to the indoor assembly.

10. The air conditioner according to claim 5, wherein the switch of the third relay and the switch of the fourth relay are normally open single-pole single-throw switches; and wherein the switch of the first relay, the switch of the second relay, and the switch of the fifth relay are single-pole double-throw switches.

11. A control apparatus, comprising:

a temperature control assembly configured to output a compressor control signal, a four-way valve control signal, a first fan control signal, and a first electrical auxiliary heating control signal;

an outdoor assembly coupled to the temperature control assembly, wherein the outdoor assembly is configured to control an operation frequency of a compressor according to the compressor control signal, to control four ports of a four-way valve to communicate in pairs according to the four-way valve control signal, and to output a second fan control signal or a third fan control signal;

an indoor assembly coupled to the temperature control assembly, wherein the indoor assembly is configured to control an air conditioner to operate in an electrical auxiliary heating mode according to the first electrical auxiliary heating control signal; and a signal control assembly coupled to the temperature control assembly, the outdoor assembly and the indoor assembly, wherein the signal control assembly is configured to transmit one of the first fan control signal, the second fan control signal, and the third fan control signal to the indoor assembly, to receive a second electrical auxiliary heating control signal, to transmit the second electrical auxiliary heating control signal to the indoor assembly, and to cut off a transmission of the third fan control signal according to the second electrical auxiliary heating control signal;

wherein the indoor assembly is further configured to control a wind speed of the indoor fan to be a first preset wind speed according to one of the first fan control signal and the second fan control signal, to control the wind speed of the indoor fan to be a second preset wind speed according to the third fan control signal, and to control the air conditioner to operate in the electric auxiliary heating mode according to the second electric auxiliary heating control signal; and wherein the first preset wind speed is greater than the second preset wind speed.

12. The control apparatus according to claim 11, wherein the signal control assembly includes:

an electrical auxiliary heating signal controller coupled to the indoor assembly, wherein the electrical auxiliary heating signal controller is configured to transmit the second electrical auxiliary heating control signal to the indoor assembly;

a fan signal controller coupled to the temperature control assembly, the outdoor assembly, and the indoor assembly, wherein the fan signal controller is configured to transmit one of the first fan control signal, the second fan control signal and the third fan control signal to the indoor assembly; and an electrical auxiliary heating protector coupled to the electrical auxiliary heating signal controller, wherein the electric auxiliary heating protector is configured to disconnect a transmission path of the third fan control signal according to the second electric auxiliary heating control signal.

13. The control apparatus according to claim 12, wherein the fan signal controller is configured to transmit the first fan control signal or the second fan control signal to the indoor assembly according to the second electrical auxiliary heating control signal.

14. The control apparatus according to claim 12, wherein the outdoor assembly includes a first outdoor unit control terminal and a second outdoor unit control terminal, and the indoor assembly includes a first preset wind speed control terminal and a second preset wind speed control terminal; and the fan signal controller includes:

a first input terminal coupled to a transmission path of the compressor control signal;

a second input terminal coupled to the transmission path of the compressor control signal;

a third input terminal coupled to the first outdoor unit control terminal of the outdoor assembly;

a fourth input terminal coupled to the second outdoor unit control terminal of the outdoor assembly;

a first output terminal coupled to a transmission path of the first electrical auxiliary heating control signal;

a second output terminal coupled to the first preset wind speed control terminal of the indoor assembly; and a third output terminal coupled to the second preset wind speed control terminal of the indoor assembly.

15. The control apparatus according to claim 14, wherein the electrical auxiliary heating signal controller includes:

a wired controller configured to control a first terminal and a second terminal of the wired controller to be short-circuited according to the second electrical auxiliary heating control signal;

the fan signal controller further includes:

a first relay, wherein a first terminal of a switch of the first relay and the first terminal of the wired controller are both coupled to the first output terminal, a second terminal of the switch of the first relay is coupled to a transmission path of the first fan control signal, and a third terminal of the switch of the first relay is coupled to a third terminal of a switch of the second relay;

a second relay, wherein a first terminal of a coil of the second relay is configured to be coupled to a common terminal, a first terminal of a switch of the second relay is coupled to the third output terminal, a second terminal of the switch of the second relay is coupled to the second output terminal;

a third relay, wherein a second terminal of a switch of the third relay is the first input terminal, a second terminal of a coil of the third relay is coupled to the fourth input terminal, and a first terminal of a coil of the first relay and the second terminal of the wired controller are both coupled to a first terminal of the switch of the third relay; and a fourth relay, wherein a second terminal of a coil of the fourth relay is used as the third input terminal, the first terminal of the coil of the third relay and a first terminal of the coil of the fourth relay are each configured to be coupled to a power supply, and a second terminal of a switch of the fourth relay is coupled to the second input terminal;

the electric auxiliary heating protector includes:

a fifth relay, wherein a second terminal of a coil of the fifth relay is coupled to the first terminal of the switch of the third relay, a first terminal of a switch of the fifth relay is in a disconnected state, a third terminal of the switch of the fifth relay is coupled to a first terminal of the switch of the fourth relay, a second terminal of the switch of the fifth relay is coupled to a second terminal of the coil of the second relay, and a second terminal of the coil of the first relay and a first terminal of the coil of the fifth relay are both coupled to the common terminal.

16. The control apparatus according to claim 15, wherein the outdoor assembly is further configured to: when the first terminal and the second terminal of the wired controller are short-circuited, receive a defrosting signal, and control the switch of the third relay to be closed and the switch of the fourth relay to be opened according to the defrosting signal, so that the first terminal and the third terminal of the switch of the first relay are connected, the first terminal and the third terminal of the switch of the fifth relay are connected, and the second terminal and the third terminal of the switch of the second relay are connected; so as to output the second fan control signal and the second electric auxiliary heating control signal to the indoor assembly; and wherein the electric auxiliary heating signal controller is configured to be powered on through the wired controller.

17. The control apparatus according to claim 15, wherein the outdoor assembly is further configured to: when the wired controller is off, receive a defrosting signal, and control the switch of the third relay to be closed and the switch of the fourth relay to be opened according to the defrosting signal, so that the first terminal and the third terminal of the switch of the first relay are connected, the first terminal and the third terminal of the switch of the fifth relay are connected, and the second terminal and the third terminal of the switch of the second relay are connected.

18. The control apparatus according to claim 15, wherein the outdoor unit is further configured to: when a frequency of the compressor is greater than a first preset frequency and the first terminal and the second terminal of the wired controller are short-circuited, control the switch of the third relay and the switch of the fourth relay to be opened, so that the second terminal and the third terminal of the switch of the first relay are connected, and the second terminal and the third terminal of the switch of the second relay are connected, so as to output the second fan control signal and the second electric auxiliary heating control signal to the indoor assembly; and the electric auxiliary heating signal controller is configured to be powered on through the wired controller.

19. The control apparatus according to claim 15, wherein the outdoor unit is further configured to: when a frequency of the compressor is less than a second preset frequency and the wired controller is off, control the switch of the third relay to be opened and the switch of the fourth relay to be closed, so that the second terminal and the third terminal of the switch of the first relay are connected, the first terminal and the third terminal of the switch of the second relay are connected, and the second terminal and the third terminal of the switch of the fifth relay are connected, so as to output the third fan control signal to the indoor assembly.

20. The control apparatus according to claim 15, wherein the switch of the third relay and the switch of the fourth relay are normally open single-pole single-throw switches; and wherein the switch of the first relay, the switch of the second relay, and the switch of the fifth relay are single-pole double-throw switches.

* * * * *